US011367566B2

(12) United States Patent
Yamada

(10) Patent No.: US 11,367,566 B2
(45) Date of Patent: Jun. 21, 2022

(54) INTERNAL COMBUSTION ENGINE IGNITION DEVICE

(71) Applicant: Mitsubishi Electric Corporation, Tokyo (JP)

(72) Inventor: Shuji Yamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 111 days.

(21) Appl. No.: 16/832,878

(22) Filed: Mar. 27, 2020

(65) Prior Publication Data

US 2021/0074473 A1 Mar. 11, 2021

(30) Foreign Application Priority Data

Sep. 11, 2019 (JP) ..... JP2019-165033

(51) Int. Cl.

| | |
|---|---|
| ***H01F 5/02*** | (2006.01) |
| ***H01F 38/12*** | (2006.01) |
| ***H01F 27/32*** | (2006.01) |
| ***H01T 15/00*** | (2006.01) |
| ***H01F 27/28*** | (2006.01) |

(52) U.S. Cl.

CPC ..... *H01F 38/12* (2013.01); *H01F 5/02* (2013.01); *H01F 27/28* (2013.01); *H01F 27/325* (2013.01); *H01T 15/00* (2013.01)

(58) Field of Classification Search

CPC .. H01F 27/00–40; H01F 38/12; H01F 27/325; H01T 15/00; F02P 3/0442; F02P 3/02

See application file for complete search history.

(56) References Cited

U.S. PATENT DOCUMENTS 6,031,443 A * 2/2000 Larsen ..... B60T 8/3615 336/192
7,570,143 B2 * 8/2009 Adunka ..... H01F 5/02 336/198

FOREIGN PATENT DOCUMENTS

JP 2017199749 A * 11/2017
JP 6448010 B2 1/2019

* cited by examiner

*Primary Examiner* — Tuyen T Nguyen

(74) *Attorney, Agent, or Firm* — Sughrue Mion, PLLC; Richard C. Turner

(57) ABSTRACT

The present application provides an internal combustion engine ignition device such that irregular winding of a primary coil and a tertiary coil and an increase in a number of components can be restricted.

A recessed portion that forms a tertiary coil winding portion is provided in a portion of a surface portion of a trunk portion of a primary bobbin, a tertiary coil is formed winding a copper wire around the recessed portion with no gap, and a primary coil is formed by winding a copper wire around a surface portion of the tertiary coil and a trunk portion surface portion of the primary bobbin in which the recessed portion is not formed, that is, a whole region of the trunk portion positioned between flanges after the tertiary coil is formed.

6 Claims, 4 Drawing Sheets

INTERNAL COMBUSTION ENGINE IGNITION DEVICE

BACKGROUND OF THE INVENTION

1. Field of the Invention

The present application relates to an internal combustion engine ignition device.

2. Description of the Related Art

An internal combustion engine ignition device is a device for causing an ignition plug to emit an ignition spark. In recent years, a high energy type of ignition device with good igniting properties has been needed in order to improve internal combustion engine fuel consumption. However, there is an adverse effect in that simply by adopting a high energy type, erosion of the ignition plug increases. Therefore, technology such that high energy is generated by adopting a configuration wherein additional magnetic flux is generated in an ignition coil, which is a constituent component of an internal combustion engine ignition device, has been proposed (for example, refer to Patent Literature 1).

Patent Literature 1: Japanese Patent No. 6,448,010

An existing ignition coil is of a configuration wherein a primary coil (a main primary coil) is wound around a primary bobbin, a primary coil external surface is covered with an insulating sheet or the like, and a tertiary coil (an auxiliary primary coil) that causes additional magnetic flux is wound around a whole of an external surface of the insulating sheet. Alternatively, a configuration is such that a bobbin is divided, and a copper wire (a magnet wire) is wound around each of a primary coil bobbin and a tertiary coil bobbin. By a tertiary coil being disposed in a layer above a primary coil across an insulating sheet, or by a multiple of bobbins being used, in this way, a primary coil and a tertiary coil are wound with no irregular winding, but there is a problem in that a number of components increases.

Meanwhile, a primary coil and a tertiary coil being wound stacked so as to form upper and lower layers without using an insulating sheet and without dividing a bobbin may, depending on a relationship between a number of turns of the coil wound on the lower layer side and a bobbin winding width, result in irregular winding of a copper wire. When irregular winding of the primary coil or the tertiary coil occurs, there is concern about a decrease in reliability, such as an external form of the coil becoming larger than in a case in which there is no irregular winding, and an insulation distance from a secondary coil disposed opposing being insufficient, leading to dielectric breakdown.

SUMMARY OF THE INVENTION

The present application, has been made to solve the problem and an object of the present application is to provide an internal combustion engine ignition device such that a primary coil and a tertiary coil can be wound around the same bobbin with no irregular winding, without causing a number of components to increase.

An internal combustion engine ignition device disclosed in the present application includes a primary coil that generates a magnetic flux by causing a direct current to flow, a secondary coil that generates a high voltage in accordance with a change in the magnetic flux, a tertiary coil magnetically coupled to the primary coil and the secondary coil, and a bobbin such that the primary coil and the tertiary coil are wound around a trunk portion, wherein the tertiary coil is housed in a recessed portion provided in one portion of a surface portion of the trunk portion of the bobbin, and the primary coil is wound around a surface portion of the tertiary coil and a surface portion of the trunk portion of the bobbin in which the recessed portion is not formed.

According to the internal combustion engine ignition device disclosed in the present application, a tertiary coil is housed in a recessed portion of a bobbin, because of which no additional component for disposing the tertiary coil is needed, the tertiary coil can be housed in the recessed portion with no surplus by adjusting a width of the recessed portion of the bobbin to a winding width of the tertiary coil, and the primary coil can be disposed on a trunk portion of the bobbin that includes a surface portion of the tertiary coil, meaning that the primary coil and the tertiary coil can be wound with no irregular winding.

The foregoing and other objects, features, aspects, and advantages of the present application will become more apparent from the following detailed description of the present application when taken in conjunction with the accompanying drawings.

DETAILED DESCRIPTION OF THE PREFERRED EMBODIMENTS

First Embodiment

Using FIGS. 1 to 5A, 5B and 5C, an internal combustion engine ignition device 100 according to a first embodiment of the present application will be described. The internal combustion engine ignition device 100 includes an ignition coil 1 as one main configuration. The internal combustion engine ignition device 100 is a high energy type of ignition device with good igniting properties appropriate to an internal combustion engine, and includes an energy consumption improving capacity.

Figure 1:
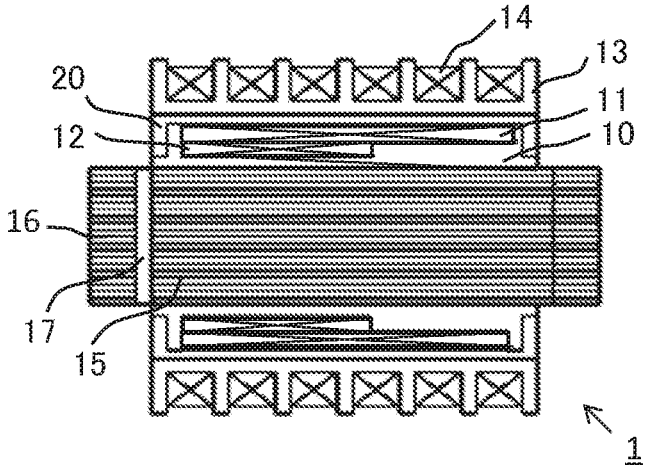
FIG. 1 is a sectional view of an ignition coil of an internal combustion engine ignition device according to a first embodiment.
Figure 2:
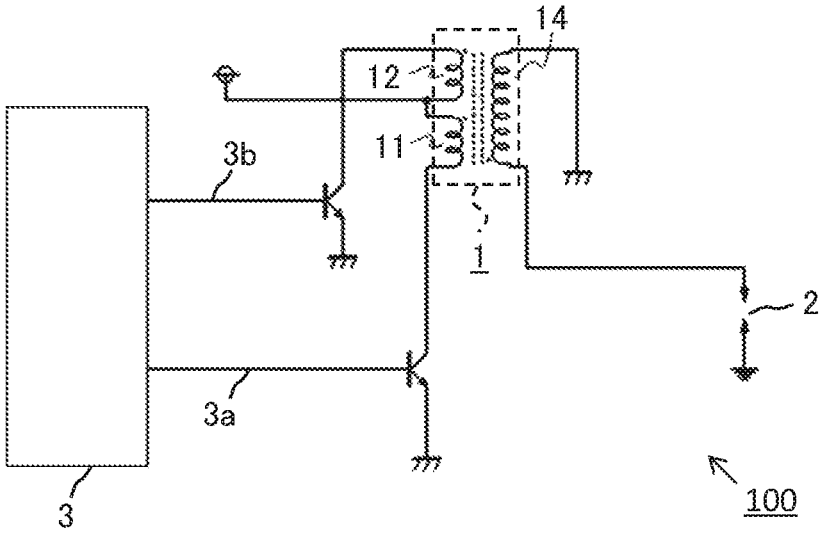
FIG. 2 is a schematic configuration diagram of the internal combustion engine ignition device.
Figure 3:
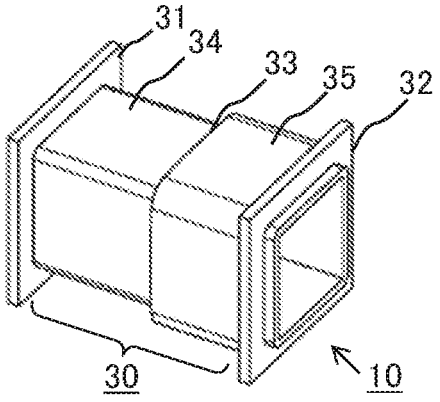
FIG. 3 is a perspective view of a primary bobbin.
Figure 4:
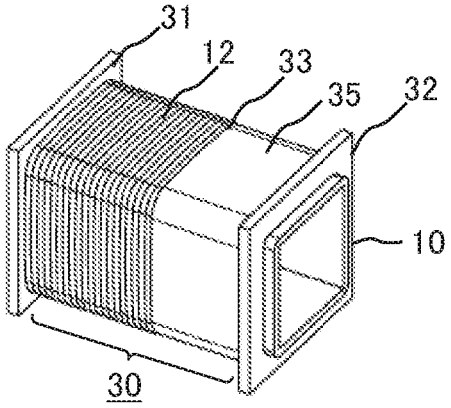
FIG. 4 is a perspective view of the primary bobbin after winding a tertiary coil.
Figure 5A:
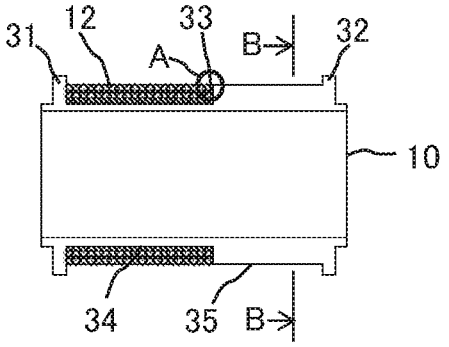
FIG. 5A is a sectional view of the primary bobbin after winding the tertiary coil.
Figure 5B:
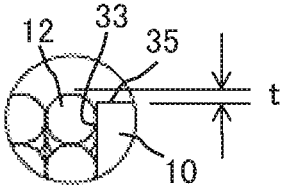
FIG. 5B is a main portion enlarged sectional view of a step portion of the primary bobbin.
Figure 5C:
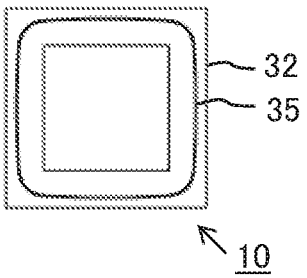
FIG. 5C is a sectional view of a trunk portion surface portion of the primary bobbin.

FIG. 1 is a sectional view of the ignition coil 1 configuring the internal combustion engine ignition device 100 (shown in FIG. 2, to be described hereafter) according to the first embodiment, and FIG. 2 is a schematic configuration diagram of the internal combustion engine ignition device 100. FIG. 3 is a perspective view of a primary bobbin 10 (corresponding to a bobbin), and FIG. 4 is a perspective view of the primary bobbin 10 at a stage at which a tertiary coil 12 is wound around the primary bobbin 10. FIG. 5A and FIG. 5C are sectional views in two directions of the tubular primary bobbin 10 at the stage at which the tertiary coil 12 is wound around the primary bobbin 10, and FIG. 5B is a main portion enlarged sectional view wherein an A portion of the primary bobbin 10 is enlarged, wherein one of the sectional views shown by FIG. 5A is a view in an axial direction, and the other shown by FIG. 5C is a view along a B-B line of the primary bobbin 10.

The ignition coil 1 shown in FIG. 1 includes a primary coil 11 that generates a magnetic flux by causing a direct current to flow, a center core 15 formed of a magnetic body wherein magnetic induction is generated owing to a magnetic field of the primary coil 11 acting, a secondary coil 14 that causes a high voltage to be generated in accordance with a change in magnetic flux, and the tertiary coil 12, which is magnetically coupled to the primary coil 11 and the secondary coil 14 and, in the same way as the primary coil 11, generates a magnetic flux by causing a direct current to flow.

A configuration is such that the primary coil 11 and the tertiary coil 12 are wound around the same primary bobbin 10 so that the tertiary coil 12 forms a lower layer (an inner side) and the primary coil 11 forms an upper layer (an outer side). The primary coil 11 and the tertiary coil 12 may each be an independent winding, or the primary coil 11 and the tertiary coil 12 may be divided by an intermediate tap or the like.

A number of turns of the lower layer side tertiary coil 12 is small with respect to a number of turns of the upper layer side primary coil 11, and the tertiary coil 12 is wound with no gap around a recessed portion 34 (shown in FIG. 3 and the like, to be described hereafter) that forms a lower step side provided in a range of one portion of a trunk portion 30 (shown in FIG. 3 and the like, to be described hereafter) of the primary bobbin 10. Further, the primary coil 11 is wound with no gap around a whole width of the trunk portion 30 of the primary bobbin 10, that is, a range of the trunk portion 30 forming an upper step side, in which the recessed portion 34 is not provided, and a surface portion of the tertiary coil 12. No insulating sheet is disposed between the tertiary coil 12 and the primary coil 11. Also, the secondary coil 14 is an independent winding wound around a secondary bobbin 13 disposed on an outer side of the primary bobbin 10.

The center core 15 is inserted through a central hole on an inner peripheral side of the primary bobbin 10. A side core 16 is disposed across a magnet 17 in one end portion of the center core 15. A circumferential path is formed by the side core 16, which is provided connected to an outer side of the secondary coil 14, and the center core 15 being connected.

The whole of the ignition coil 1 is sealed using an epoxy resin. Further, an insulating portion 20 formed of the epoxy resin is interposed between the primary bobbin 10 and the secondary bobbin 13. The epoxy resin performs roles of insulating, sealing, and fixing each component.

As shown in the schematic configuration diagram of the internal combustion engine ignition device 100 in FIG. 2, one end of the primary coil 11 is connected to a battery, and another end is connected to a switching ignitor of the primary coil 11. The same applying to the tertiary coil 12, one end is connected to a battery (or a ground), and another end is connected to a switching ignitor of the tertiary coil 12. A primary coil control signal 3*a* and a tertiary coil control signal 3*b* output from an engine control unit 3 are input into the primary coil 11 and the tertiary coil 12 respectively.

The internal combustion engine ignition device 100 configured in this way is such that energization and interruption of the primary coil 11 and the tertiary coil 12 can be controlled individually.

Further, by carrying out ignition control such that the tertiary coil 12 is energized subsequent to a timing at which energization of the primary coil 11 is interrupted, discharge energy generated in the secondary coil 14 can be caused to increase cumulatively.

A low voltage side end of the secondary coil 14 is connected via a high voltage diode to a battery or a ground using unshown connecting means or the like, and another end is connected to an ignition plug 2 that forms an output terminal.

FIG. 3 is a perspective view of the primary bobbin 10 according to the first embodiment. For example, a sectional form of the primary bobbin 10 is a rectangular, tubular form, and a corner portion thereof is chamfered, as shown in FIG. 3. A flange 31 is provided at one end in the axial direction (the longitudinal direction of the tubular form) of the primary bobbin 10, a flange 32 is provided at another end, and a region between the one flange 31 and the other flange 32 is the trunk portion 30 that forms the portion of the primary bobbin 10 around which coils are wound. The recessed portion 34 that houses the tertiary coil 12 is provided in one portion of the trunk portion 30.

The recessed portion 34 is of a form such that a surface portion of the trunk portion 30 is hollowed out to a predetermined width and a predetermined depth, and is provided from an inner face of the one flange 31 toward the other flange 32 in a range not reaching the other flange 32, and the tertiary coil 12 is housed in the recessed portion 34 in a state wound with no gap.

Owing to the recessed portion 34 being formed in the primary bobbin 10, a step portion 33 is formed in an intermediate position in the axial direction of the trunk portion 30, as shown in FIG. 3. The surface portion of the trunk portion 30 is divided into the upper step side and the lower step side by the step portion 33. A region reaching the inner face of the one flange 31 from the step portion 33 is the lower step side, and the recessed portion 34, wherein a trunk portion surface portion 35 is hollowed out, is provided therein, while a region reaching the other flange 32 from the step portion 33 is the upper step side, and the trunk portion surface portion 35, around which the primary coil 11 is wound, is exposed therein.

FIG. 4 shows a state in which the tertiary coil 12 is wound around the primary bobbin 10, wherein the tertiary coil 12, whose number of turns is set to be less than that of the primary coil 11, is wound with no surplus around the recessed portion 34 provided in the trunk portion 30 of the primary bobbin 10. The width of the recessed portion 34 of the primary bobbin 10, that is, the distance between the one flange 31 and the step portion 33 provided in the trunk portion 30, is set to a dimension such that the number of turns of the tertiary coil 12 is housed with no surplus.

Further, unshown end portion holding portions of the primary coil 11 and the tertiary coil 12 are installed in a direction of extension of the one flange 31 of the primary bobbin 10, and end portions of the primary coil 11 and the tertiary coil 12 are fixed by the end portion holding portions.

By the recessed portion 34 being filled by the tertiary coil 12 in the state in which the tertiary coil 12 is wound around the primary bobbin 10, a surface portion that forms a foundation when winding the primary coil 11 is levelled, as shown in FIG. 5A. Further, the surface portion of the tertiary coil 12 that forms a foundation of the primary coil 11 and the trunk portion surface portion 35 are provided continuously so as to be practically flush.

When winding the primary coil 11 around the whole of the trunk portion 30 between the one flange 31 and the other flange 32 after winding the tertiary coil 12, the primary coil 11 can be wound on a flat foundation, because of which irregular winding can be restricted.

Herein, when winding copper wire (a wire diameter is in the region of Φ0.4 to Φ0.7) around the primary bobbin 10, winding is carried out while applying tension within a range that does not affect a resistance value of the copper wire, but the copper wire not necessarily being wound following the form of the primary bobbin 10, the copper wire is wound in contact with a corner portion of the primary bobbin 10, while the copper wire is wound in a non-contact state in a flat portion of the primary bobbin 10. This state of the copper wire not being in contact in the trunk portion surface portion 35 is called bulging of the copper wire when winding.

As shown by the enlarged sectional view of the step portion 33 in the region indicated by reference sign A (shown in FIG. 5A) in FIG. 5B, a height of the step portion 33 (the same as a height of the trunk portion surface portion 35) of the primary bobbin 10 is set so as to be 0.1 mm to 0.3 mm (indicated by reference sign t in the drawing) smaller than an external form of the tertiary coil 12 after winding the tertiary coil 12 (the stage before winding the primary coil 11). When winding the primary coil 11 around an outer periphery of the tertiary coil 12, which bulges when wound, the bulging of the tertiary coil 12 is suppressed by the tension applied when winding the primary coil 11, and the bulging reaches a state of being crushed small, because of which a height of the step portion 33 of the primary bobbin 10 that takes a dimension of the crushing (the same as the dimension indicated by reference sign t) into consideration is set.

Also, as shown by the sectional view of the primary bobbin 10, including a sectional form of the trunk portion surface portion 35, indicated by reference sign B (shown in FIG. 5A) in FIG. 5C, a form of the trunk portion surface portion 35 on an upper side of the step portion 33 provided in the trunk portion 30 of the primary bobbin 10 is a convex form that takes bulging of the copper wire surface portion when winding the tertiary coil 12 into consideration. The convex form is a form wherein a central portion of a line linking neighboring corner portions of the primary bobbin 10, which has a polygonal cross-section, is caused to bulge outward, and an apex thereof is of a rounded form shifted 0.2 mm to 0.5 mm outward with respect to the line linking the corner portions.

In the heretofore described example, the recessed portion 34 is disposed in contact with one end portion of the trunk portion 30 of the primary bobbin 10, but the recessed portion 34 can also be disposed in a central portion of the trunk portion 30, and not in contact with the flanges 31 and 32.

Provisionally, when the primary coil 11 is wound first, after which the tertiary coil 12 is wound around the surface of the primary coil 11, in a state in which the recessed portion 34 is not provided in the primary bobbin 10, with a holding of an end portion of the copper wire being on one side of the primary bobbin 10 as a precondition, the winding width of the tertiary coil 12, which has a smaller number of turns, is of course smaller than the winding width of the primary coil 11, which has a greater number of turns, and folding back at a place on the primary bobbin 10 not in contact with the flange 32 is necessary, which causes irregular winding.

However, by winding the tertiary coil 12 so as to be housed in the recessed portion 34 of the primary bobbin 10, and winding the primary coil 11 more widely so as to reach a state covering the tertiary coil 12 on the upper layer side of the same primary bobbin 10, as is the case with the internal combustion engine ignition device 100 according to the first embodiment, a face portion of the step portion 33 vertical to the axis is in contact with a folded back portion of the winding, whereby irregular winding can be restricted.

Also, because of a tolerance with respect to copper wire diameter and a tolerance with respect to the primary bobbin 10, it is rare when actually winding the copper wire that the primary coil 11 and the tertiary coil 12 are wound with no surplus with respect to the winding width, and this tendency is more pronounced the greater the number of turns. This means that by disposing the tertiary coil 12, which has a smaller number of turns than the primary coil 11, on the inner side, deformation occurring in the foundation of the primary coil 11 due to the aforementioned kind of tolerance can be kept small, and it can be said that this configuration is structurally advantageous with respect to irregular winding.

Although the internal combustion engine ignition device 100 has been described, it goes without saying that this configuration of the ignition coil 1 can also be used in an application other than an internal combustion engine.

Second Embodiment

Figure 6A:
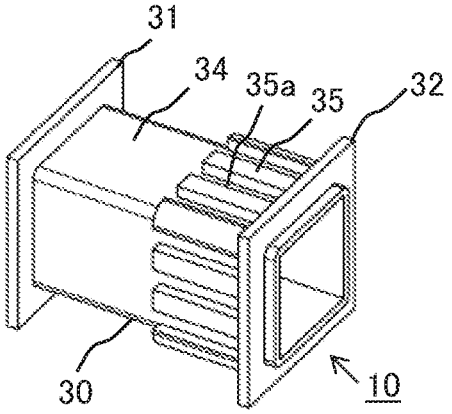
FIG. 6A is a perspective view of the primary bobbin of the internal combustion engine ignition device according to a second embodiment.
Figure 6B:
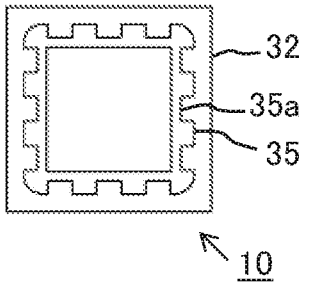
FIG. 6B is a sectional view of the trunk portion surface portion of the primary bobbin.

FIG. 6A and FIG. 6B are a perspective view and a sectional view showing an example of a configuration of the primary bobbin 10 of the internal combustion engine ignition device 100 of a second embodiment. In the second embodiment, a description will be given of a configuration for reducing failures such as a void or a sink occurring in the trunk portion 30 of the primary bobbin 10. Specifically, stripe form (slit form) reduced thickness portions 35*a* are provided in the axial direction of the primary bobbin 10 in the trunk portion surface portion 35 in a region of the trunk portion 30 of a thickness such that the recessed portion 34 is not provided, as shown in FIG. 6A and FIG. 6B.

The primary bobbin 10 according to the first embodiment is such that the region of the crank portion 30 shown as the trunk portion surface portion 35, around which the tertiary coil 12 is not wound, is thicker by the depth of the recessed portion 34 than the region in which the recessed portion 34 is formed. Further, due to a thicker portion being formed in the primary bobbin 10, voids and sinks are liable to occur in the thicker portion.

In order to prevent voids and sinks, the stripe form reduced thickness portions 35*a*, which are hollowed out inwardly from the trunk portion surface portion 35 of the primary bobbin 10, are formed as shown in FIG. 6A and FIG. 6B. The reduced thickness portions 35*a* are desirably formed in a stripe form extending in a direction (the longitudinal axial direction of the tubular primary bobbin 10) vertical to the winding direction of the primary coil 11, are set to a size that does not impede the winding of the primary coil 11, and, taking a material flow when molding the primary bobbin 10 into consideration, are installed at equal intervals in order to approach uniform thickness.

By the reduced thickness portion 35*a* being formed, a reduction in strength due to a void and an irregular winding of copper wire due to a sink can be restricted.

It goes without saying that the reduced thickness portion 35*a* is provided in such a way that a corner portion in a circumferential direction of the trunk portion 30 is avoided.

Third Embodiment

Figure 7:
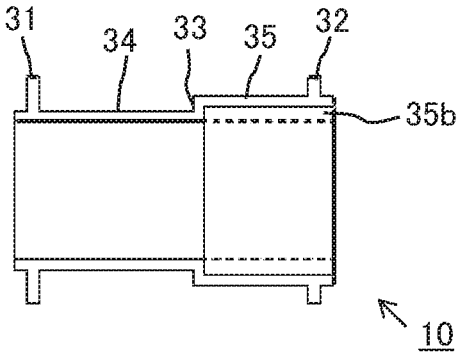
FIG. 7 is a sectional view of the primary bobbin of the internal combustion engine ignition device according to a third embodiment.

FIG. 7 is a sectional view showing an example of a configuration of the primary bobbin 10 of the internal combustion engine ignition device 100 of a third embodiment. In the above-described second embodiment, an example wherein the reduced thickness portion 35*a* is formed by hollowing out the trunk portion surface portion 35 inwardly from the outer periphery is presented. In the third embodiment, a case wherein a reduced thickness portion 35*b* is formed by thinning an inner side of the tubular trunk portion 30, without causing the external form of the trunk portion surface portion 35 to change, will be described.

As shown in FIG. 7, the thickness is reduced evenly by thinning on an inner peripheral side of the trunk portion surface portion 35, whereby the reduced thickness portion 35*b* is provided, and an inner peripheral portion of the primary bobbin 10 is in an enlarged state in the region in which the reduced thickness portion 35*b* is provided. The reduced thickness portion 35*b* is formed over the whole periphery of the trunk portion 30 so that the thickness of the trunk portion surface portion 35 in which the reduced thickness portion 35*b* is provided is equal to the thickness of the recessed portion 34, in which the reduced thickness portion 35*b* is not provided.

By the reduced thickness portion 35*b* being formed, a region of contact between the center core 15 and the primary bobbin 10 when forming the ignition coil 1 is in a reduced state, but as a gap between the central hole of the primary bobbin 10 and an inner peripheral face of the reduced thickness portion 35*b* is filled with an epoxy resin or the like, fixing strength does not decrease.

Also, it goes without saying that instead of being provided over the whole inner periphery of the trunk portion 30, the reduced thickness portion 35*b* can be provided in stripe form, as in the second embodiment. In this case, the stripe form reduced thickness portions can be disposed continuously at equal intervals in the circumferential direction.

Also, a configuration can also be such that the stripe form reduced thickness portion 35*b* hollowed out from the inner peripheral side of the trunk portion 30 to the outer peripheral side is provided between two of the stripe form reduced thickness portions 35*a* hollowed out from the outer peripheral side of the trunk portion 30 shown in the second embodiment. By so doing, a cross-section of the trunk portion 30 becomes an irregular form wherein the reduced thickness portions 35*a* and 35*b* are alternately continuous in the circumferential direction, and the thickness of the whole of the trunk portion 30 can be equalized, because of which manufacturing reliability can be improved.

Although the present application is described above in terms of various exemplary embodiments and implementations, it should be understood that the various features, aspects, and functionalities described in one or more of the individual embodiments are not limited in their applicability to the particular embodiment with which they are described, but instead can be applied, alone or in various combinations, to one or more of the embodiments.

It is therefore understood that numerous modifications that have not been exemplified can be devised without departing from the scope of the present application. For example, at least one constituent component may be modified, added, or eliminated. At least one of the constituent components mentioned in at least one of the preferred embodiments may be selected and combined with the constituent components mentioned in another preferred embodiment.

What is claimed is:

1. An internal combustion engine ignition device, comprising:

a primary coil that generates a magnetic flux by causing a direct current to flow;

a secondary coil that generates a high voltage in accordance with a change in the magnetic flux;

a tertiary coil magnetically coupled to the primary coil and the secondary coil; and a bobbin such that the primary coil and the tertiary coil are wound around a trunk portion, wherein the tertiary coil is housed in a recessed portion provided in one portion of a surface portion of the trunk portion of the bobbin, and the primary coil is wound around a surface portion of the tertiary coil and a surface portion of the trunk portion of the bobbin in which the recessed portion is not formed, and a reduced thickness portion is provided in a region of the trunk portion of the bobbin in which the recessed portion is not provided, the reduced thickness portion extending in an axial direction.

2. The internal combustion engine ignition device according to claim 1, wherein flanges are provided one each in either end portion of the trunk portion of the bobbin, the recessed portion is provided from an inner face of one of the flanges toward the other flange in a range not reaching the other flange, and the tertiary coil is housed with no gap in the recessed portion.

3. The internal combustion engine ignition device according to claim 1, wherein the surface portion of the tertiary coil and the surface portion of the trunk portion of the bobbin are provided continuously.

4. The internal combustion engine ignition device according to claim 1, wherein a sectional form of the trunk portion of the bobbin is polygonal, and the surface portion of the trunk portion of the bobbin is formed in a convex form such that a central portion of a line linking neighboring corner portions is caused to bulge outward.

5. The internal combustion engine ignition device according to claim 1, wherein the reduced thickness portion is provided in a stripe form extending in a direction vertical to a winding direction of the primary coil on the surface portion side of the bobbin.

6. The internal combustion engine ignition device according to claim 1, wherein the reduced thickness portion is provided on an inner peripheral side of the bobbin, which is tubular.

* * * * *